US006224233B1

(12) United States Patent
Fischer et al.

(10) Patent No.: US 6,224,233 B1
(45) **Date of Patent: *May 1, 2001**

(54) CANOPY LUMINAIRE

(75) Inventors: Jerry F. Fischer, West Chester; Robert E. Kaeser, Cincinnati, both of OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/447,992

(22) Filed: Nov. 23, 1999

Related U.S. Application Data

(63) Continuation of application No. 08/890,118, filed on Jul. 9, 1997, now Pat. No. 6,059,422, which is a continuation of application No. 08/532,901, filed on Sep. 22, 1995, now Pat. No. 5,662,407.

(51) Int. Cl.[7] ..... F21S 8/04

(52) U.S. Cl. ..... 362/147; 362/365; 362/368; 362/226

(58) Field of Search ..... 362/365, 226, 362/368, 147, 343, 375, 374

(56) References Cited

U.S. PATENT DOCUMENTS

| | | | |
|---|---|---|---|
| 1,248,187 | 11/1917 | Smith . | |
| 1,678,137 | 7/1928 | Douglas . | |
| 2,225,057 | 12/1940 | Kuntz . | |
| 2,225,217 | 12/1940 | Hicok . | |
| 2,700,751 | 1/1955 | Hallerberg . | |
| 2,712,120 | 6/1955 | Cochran . | |
| 3,176,255 | 3/1965 | Jensen . | |
| 3,387,255 | 6/1968 | Earleywine, Jr. . | |
| 3,511,982 | 5/1970 | Salter . | |
| 4,071,749 | 1/1978 | Balogh | 362/20 |
| 4,250,540 | 2/1981 | Kristofek | 362/368 |
| 4,315,302 | 2/1982 | Petralia | 362/226 |
| 4,326,243 | 4/1982 | Pistor etal. | 362/368 |
| 4,384,316 | 5/1983 | de Vos et al. | 362/147 |
| 4,459,648 | 7/1984 | Ullman | 362/307 |
| 4,460,948 | 7/1984 | Malola | 362/396 |
| 4,462,068 | 7/1984 | Shadwick | 362/332 |
| 4,516,196 | 5/1985 | Blake | 362/311 |
| 4,547,840 | 10/1985 | Tinder | 362/226 |
| 4,654,768 | 3/1987 | Dryman et al. | 362/374 |
| 4,703,406 | 10/1987 | Elliott et al. | 362/365 |
| 4,739,460 | 4/1988 | Kelsall | 362/365 |
| 4,760,510 | 7/1988 | Lahti | 362/365 |

(List continued on next page.)

OTHER PUBLICATIONS

Lithonia Lighting, *High–Abuse Lighting*, Brochure, 1996 (3 pgs).
Lithonia Lighting, *Product Selection Guide, Edition 2*, Brochure, 1991, Rev. Feb. 1993 (4 pgs.).
Web Page, Lithonia Lighting, Jul. 1999.
Holophane, *Compact PrismGlo Series*, p.58, Mar. 31, 1993.
Holophane, *Indoor RefractopackV*, p. 99, Mar. 31, 1993.

*Primary Examiner*—Thomas M. Sember
(74) *Attorney, Agent, or Firm*—Wood, Herron & Evans, L.L.P.

(57) ABSTRACT

A canopy luminaire (10, 110, 210) for mounting by a single individual in a canopy comprises a luminaire housing (12, 112, 212) having a bulbous body (14, 114) configured to receive the light-emitting section of a lamp and a narrow neck (16, 116). Spring clips (26, 124) are secured to opposing sides of the narrow neck (16, 116) and are adapted to support the luminaire (10, 110) from a canopy. A locking component (31) may be attached to the narrow neck (16, 116) to fixedly secure the luminaire (10, 110, 210) to the canopy. The luminaire (10, 110, 210) may also include externally mounted control gear (80), such as the ballast. Further, the luminaire (10, 110, 210) may include a hingedly attached glass lens (42) to permit quick and easy replacement of lamps. Alternatively, luminaire (210) may include a rotatably attached glass lens (240).

27 Claims, 8 Drawing Sheets

U.S. PATENT DOCUMENTS

| | | | |
|---|---|---|---|
| 4,763,231 | 8/1988 | Houplain | 362/148 |
| 5,045,984 | 9/1991 | Trowbridge et al. | 362/365 |
| 5,068,772 | 11/1991 | Shapiro et al. | 362/365 |
| 5,122,944 | 6/1992 | Webb | 362/365 |
| 5,174,642 | 12/1992 | Brohard et al. | 362/20 |
| 5,222,800 | 6/1993 | Chan et al. | 362/147 |
| 5,228,773 | 7/1993 | Win | 362/339 |
| 5,394,316 | 2/1995 | Holbrook et al. | 362/294 |
| 5,440,471 | 8/1995 | Zadeh | 362/365 |
| 5,465,199 | 11/1995 | Stauber | 270/53 |
| 5,548,499 | 8/1996 | Zadeh | 362/366 |
| 5,560,707 | 10/1996 | Neer | 362/376 |
| 5,562,341 | 10/1996 | Strauss | 362/226 |
| 5,567,041 | 10/1996 | Slocum | 362/148 |
| 5,574,600 | 11/1996 | Agro | 359/818 |
| 5,927,843 | 7/1999 | Haugaard et al. | 362/147 |

CANOPY LUMINAIRE

This application is a continuation application of U.S. application Ser. No. 08/890,118 filed Jul. 9, 1997, now U.S. Pat. No. 6,059,422, which is a continuation application of U.S. application Ser. No. 08/532,901, filed Sep. 22, 1995, now U.S. Pat. No. 5,662,407.

FIELD OF THE INVENTION

This invention relates generally to canopy luminaires and more particularly to canopy luminaires adapted to be mounted to a horizontal mounting member by a single individual.

BACKGROUND OF THE INVENTION

Canopy luminaires are typically mounted on or in a flat horizontal member. They are used in many applications ranging from canopies over fuel pumps in a service station, to storefronts for convenience stores, to drive-throughs of restaurants. To provide the desired level of lighting, canopy luminaires typically use high intensity discharge (HID) lamps.

HID light sources are regulated by control gear, which may include a ballast alone or in combination with other components such as capacitors, igniters, or other such equipment. This control gear may be as large as or larger than the lamp itself. Further, the lamp and control gear are frequently contained within a box-like housing, which must be mounted to the support structure.

To mount luminaires of currently existing designs, generally an opening must be made in the canopy in which the luminaire is to be mounted. As the canopy luminaire is in a box-like housing, an opening sized to receive that structure must be made. The luminaire is then mounted to the horizontal member of the support structure by brackets or other equipment, which typically requires a significant amount of manual labor. Further, cutting the substantial hole within the mounting member and installing the canopy luminaire into horizontal member typically requires the use of at least two electricians, resulting in a high installation cost.

Moreover, in luminaires of currently existing designs, the ballast is generally located within the housing with the other components of the luminaire. As a result, the operating temperature of the ballast and other control gear is increased due to exposure to heat from the HID lamp. This results in a corresponding reduction in the useful life of the components. Thus, the ballast and other control gear must be replaced on a more frequent basis than would otherwise be needed. As with installation, this too is an expensive procedure, as two individuals again are required, both of which generally must be electricians.

Another drawback associated with existing luminaires is that they frequently mount the HID lamp horizontally within the mounting structure. This degrades the amount of light emanating from the lamp, as approximately one-half of the luminous output of the lamp is directed upwardly, away from the target area. Although reflectors are used to reduce the amount of wasted light, a substantial portion of the luminous output of the lamp is nevertheless lost.

A still further drawback associated with existing luminaires is the difficulty in replacing the lamp. Typically, the glass lens of the luminaire is secured to the lamp housing by screws or similar fastening devices. To replace the lamp, an individual must use a ladder to reach the luminaire, loosen the fasteners to release the glass lens, and then replace the lamp. This is a time consuming procedure, often requiring more than one individual.

Thus, there is a substantial need for a canopy luminaire that may be easily and quickly mounted to a horizontal mounting member by a single individual. Further, there is a significant need for a canopy luminaire that mounts the lamp vertically to improve the lighting of the target area. Still further, there is a need for a canopy luminaire that extends the life of the ballast and other control gear and which permits quick and easy replacement of the lamp.

SUMMARY OF THE INVENTION

The present invention provides a canopy luminaire which overcomes drawbacks associated with the currently existing luminaires. More specifically, the canopy luminaire of the present invention comprises a luminaire housing having a bulbous body configured to receive the light-emitting section of a lamp and a narrow neck extending therefrom with an inner end connected to the bulbous body and an outer end, and a socket disposed within the narrow neck opening toward the bulbous body and which is sized to receive the base of a lamp. A spring clip for securement of the luminaire housing to a mounting structure having an opening into which the outer end of the narrow neck is inserted has an upper end secured to the narrow neck and a lower end extending downwardly and biased outwardly from the narrow neck. The narrow neck may be adapted to receive a locking component to fixedly secure the luminaire to a mounting member, wherein the mounting member opening is located between the locking component and the bulbous body.

The lower end of the spring clip is spaced above the bulbous body of the housing a distance sufficient to receive the mounting member therebetween. Preferably, there are two spring clips, which are secured on opposing sides of the narrow neck.

Preferably, the socket is oriented vertically and is sized to receive the base of a high intensity discharge lamp. Moreover, the luminaire may include a ballast that is external to the housing of the luminaire.

The locking component may comprise a threaded nut sized to receive the narrow neck therein and whose threads are sized to engage threads formed on the inner end of the narrow neck. The threads on the narrow neck comprise a plurality of threaded segments located circumferentially about the inner end of the narrow neck. The spring clip extends downwardly into the gap formed between two of the segments and the lower end of the spring clip is based outwardly beyond the outer surface of the threaded segments.

Alternatively, the locking component may comprise a clamp having an upper end adapted to be secured to the narrow neck, a lower end, and an opening therebetween sized to receive the narrow neck. The lower end of the clamp engages the mounting member to fixedly secure the luminaire thereto when the upper end of the clamp is secured to the narrow neck. Preferably the clamp is frustro-conical in shape, with the upper end having a diameter smaller than the lower end. Further, the lower end may include an outwardly extending annular flange for engaging the mounting member. The upper end of the clamp is secured to the narrow neck by a plurality of threaded fasteners.

Further to another aspect of the present invention, the canopy luminaire further comprises a spring clasp secured to the body of the luminaire housing at a first end and a glass lens hingedly attached to the body of the housing at a second end, opposite the first end, permitting the glass lens to swing between an open position and a closed position. The glass lens further includes a latch positioned for releasable engagement with the spring clasp and a handle secured to the glass lens to permit opening and closing of the lens.

In use, the single installer forms an opening in the horizontal mounting member that is sized to receive the narrow neck of the luminaire housing. The installer inserts the outer end of the narrow neck of the housing upwardly into the opening in the horizontal mounting member such that the periphery of the opening engages and deflects inwardly the spring clip. The installer continues to extend the neck upwardly through the opening until the spring clip emerges upwardly above the mounting member such that the spring clip is biased outwardly toward its original undeflected state. Thereafter, the installer may release the luminaire housing, which will be supported on the mounting member by the spring clip.

To permanently secure the luminaire to the mounting member, the installer may then go to the top of the mounting member and secure the locking component to the narrow neck, such as by securing the threaded collar onto the threads, or by securing the upper end of the clamp to the narrow neck, thereby engaging the lower end of the clamp with the mounting member.

To replace the lamp of the canopy luminaire, an individual uses a lamp changing pole having a generally C-shaped hook on a first end and a lamp gripper on a second, opposite end. The user engages the handle of the glass lens with the hook and moves the pole downwardly, releasing the latch from the spring clasp. The user may then swing the glass lens to the open position, supporting the handle in the hook. Upon reaching the open position, the user disengages the hook from the handle, inverts the pole, and engages the lamp with the lamp gripper. The lamp is removed from the base and the user inserts a second lamp, again using the lamp gripper. The pole is again inverted and the user engages the handle with the hook, swinging the glass lens to the closed position and releasably engaging the latch in the spring clasp.

Further to another aspect of the present invention, the bulbous body of the canopy luminaire may comprise a base having a periphery with a stop and a shelf extending from the periphery. The shelf includes a floor having a recess formed therein, the shelf and periphery forming a channel. The glass lens has a foot with a detent extending therefrom, the foot being sized to be slidably received in the channel to support the lens. The stop is adapted to engage the foot to limit the sliding movement of the foot in the channel and the detent operatively engages the recess to releasably hold the lens to the base. A gasket is secured in a peripheral groove formed along the periphery of the base and is intermediate the base and the foot of the glass lens. The gasket is deformed to permit the detent to be slidably received in the channel and urges the detent into the recess. Preferably, the foot is rotatably received in the channel. Further, the periphery of the base is a polygon (preferably square) with a shelf positioned at each other.

In use, the glass lens is secured to the base by pressing the lens against and deflecting the gasket. The glass lens is then rotated in a first direction until the foot contacts the stops. The lens is then released and the detents operatively engage the recesses in the shelves. To remove the glass lens, the glass lens is pressed against the gasket, deforming same. The glass lens is rotated in a second direction until the foot is released from the shelf. The glass lens is then removed.

By virtue of the foregoing, there is thus provided a canopy luminaire that may be easily, quickly and reliably mounted to a horizontal mounting member by a single individual. Additionally, the luminaire mounts the high intensity discharge lamp vertically to more fully light the target area. The luminaire also includes a ballast that may be positioned in an external location, to improve the useful life thereof by reducing the temperature to which the ballast is subjected. Still further, the luminaire is adapted to enable a single individual to quickly and easily replace the lamp.

These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
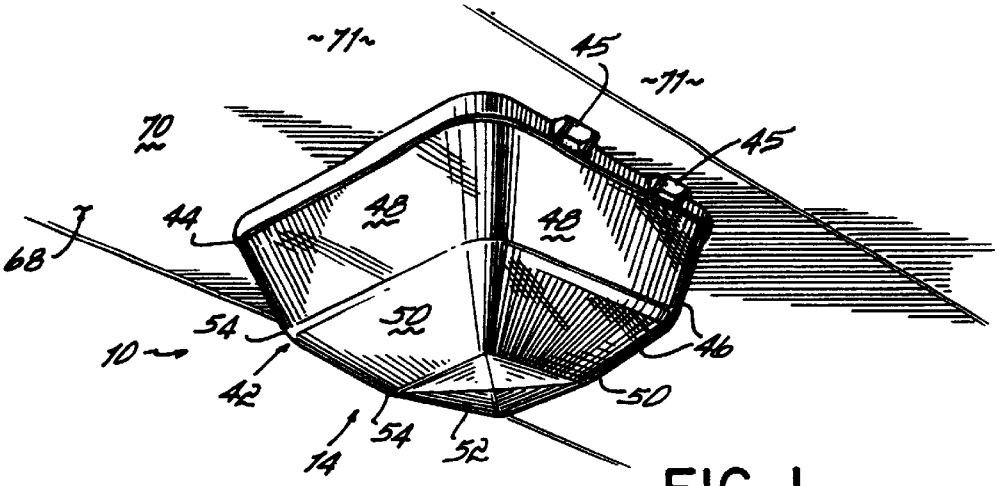
FIG. 1 is a bottom perspective view of a canopy luminaire in accordance with the principles of the present invention.
Figure 2:
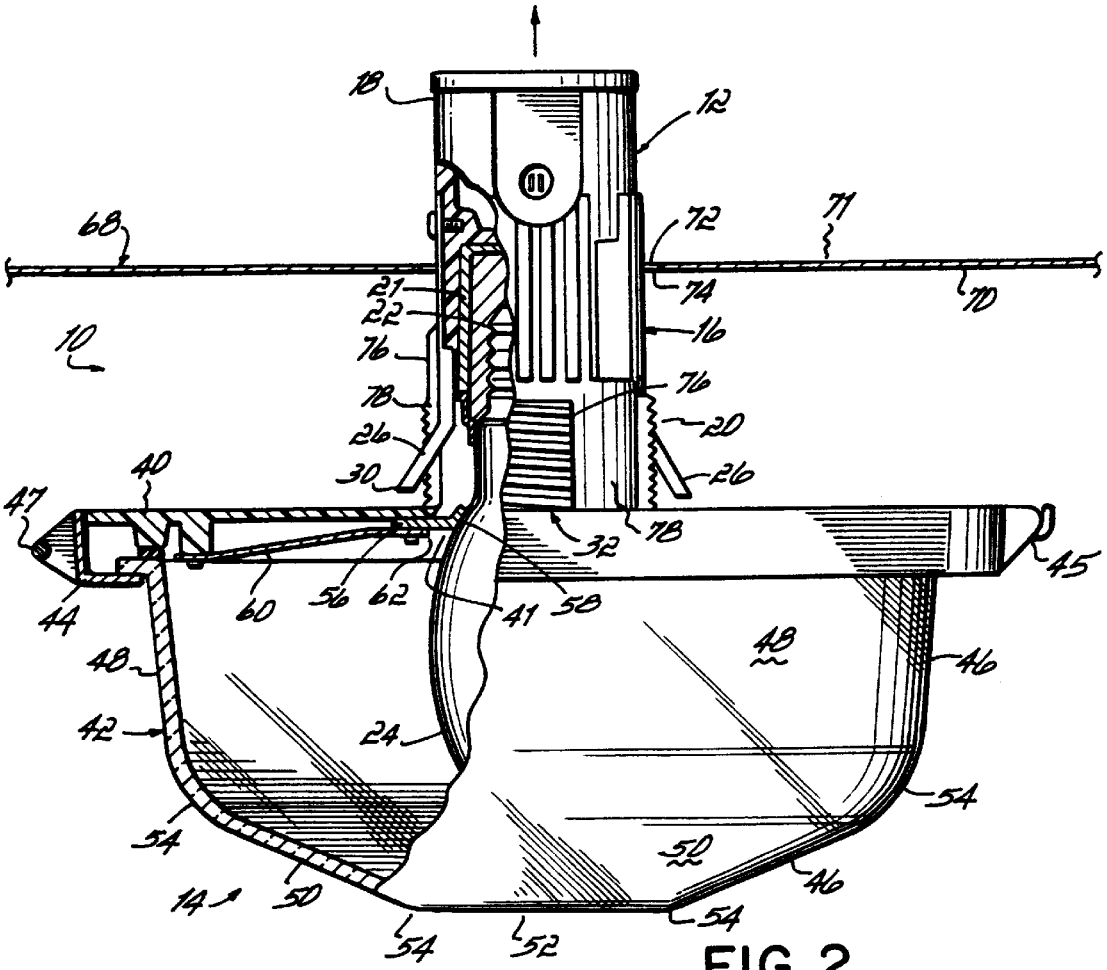
FIG. 2 is a front view partially in cross-section of the canopy luminaire of FIG. 1 partially inserted into an opening in a horizontal mounting member.
Figure 3:
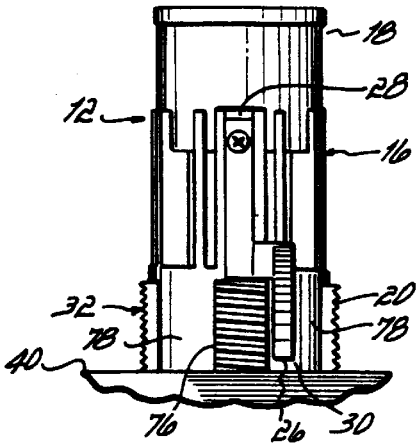
FIG. 3 is a partial side view of the upper portion FIG. 2 of the canopy luminaire.

With reference to FIGS. 1–3, there is shown a canopy luminaire 10 comprising a housing 12 having a bulbous body 14 configured to receive the light-emitting section of a lamp and a generally cyclindrical narrow neck 16 with an outer end 18 and an inner end 20 connected to bulbous body 14. Disposed within outer end 18 of narrow neck 16 is a socket 21 sized to receive the base 22 of a lamp 24, such as a high intensity discharge (HID) lamp as shown. A pair of spring clips 26 are secured at an upper end 28 to opposing sides of outer end 18 of narrow neck 16 and extend downwardly adjacent inner end 20 and are biased outwardly therefrom to a lower end 30 for supporting luminaire housing 12 from a mounting member as will be described below. Further, luminaire 10 may include a locking component 31 for fixedly securing luminaire housing 12 to a mounting member. Specifically, located at inner end 20 of narrow neck 16, and adjacent bulbous body 14, are threads 32 adapted to receive a threaded nut 34. (See FIGS. 4 and 5.) Housing 12 is preferably manufactured from die cast aluminum which provides a light but strong construction, and which readily dissipates heat to prolong component life.

Bulbous body 14 comprises a base 40 extending outwardly from inner end 20 of narrow neck 16. A prismatic glass lens 42 surrounded by frame 44 is hingedly secured to base 40 by hinges 45, which permit glass lens 42 to swing between a closed position as shown and an open position (see FIG. 11). A handle 47 is secured to frame 44 for opening and closing glass lens 42. Base 40, which is generally square, although any shape may be used, includes a centrally-positioned aperture 41 formed therein to permit passage of the base 22 of lamp 24 therethrough. Glass lens 42 has a plurality of sides 46, each side having an upper panel 48 and a lower panel 50. The lower ends of sides 46 are joined by a face 52 and the sides 46 are joined by corner sections 54.

Located within bulbous body 14 may be an annular thermal stop 56 that is secured to base 40 near aperture 41 having an inner perimeter 58 sized to abut the outer surface of lamp 24. Thermal stop 56 serves to reduce the amount of heat being transmitted from lamp 24 upwardly into narrow neck 16. Also included within bulbous body 14 is a reflector 60, such as a specular reflector, that is adapted to reflect incident light outwardly through glass lens 42. Reflector 60 has an aperture 62 formed therein to permit passage of lamp 24 therethrough and has a round or square outer configuration to substantially cover base 40. Preferably, reflector 60 is manufactured from specular aluminum. However, any reflective material may be used.

Luminaire housing 12 is generally adapted to be mounted to a horizontal mounting member, such as the canopy over fuel pumps in a service station. Moreover, socket 22 is preferably oriented vertically such that lamp 24 is suspended downwardly within luminaire housing 12. This provides several advantages. First, lighting effectiveness depends upon the orientation of lamp 24. Mounting of lamp 24 horizontally would result in approximately half of the emitted light from lamp 24 being projected upwardly and away from the target area. By contrast, vertical mounting of lamp 24 provides for uniform downward projection of light. Moreover, it has been found that vertical mounting results in a greater total luminous output.

Additionally, it is preferably to recess luminaire housing 12 within the mounting member both to improve the aesthetic appearance of the luminaire and to reduce the chances of physical damage thereto. The structure of luminaire housing 12 of the present invention provides for recessed mounting thereof by a single individual. Thus, unlike existing canopy luminaires requiring two or more individuals for installation, the canopy luminaire 10 of the present invention may be quickly and easily installed by a single individual.

More particularly, spring clips 26 are adapted to secure luminaire housing 12 to a mounting member, such as a horizontal mounting member 70 of a canopy 68. To this end, spring clips 26, which preferably have a rectangular cross-section, although any cross-sectional shape may be used, are formed from galvanized or stainless steel, tempered aluminum, plastic, or other material and have an upper end 28 secured to outer end 18 of narrow neck 16. Although two spring clips 26 are shown, it will be readily appreciated that any number of spring clips may be used without departing from the spirit or scope of the present invention. Spring clips 26 extend downwardly along narrow neck 16 and adjacent inner end 20, with the lower end 30 of spring clips 26 being biased outwardly therefrom such that lower end 30 extends outwardly of the outer surface of threads 32. Moreover, lower end 30 of spring clips 26 are spaced above base 40 of bulbous body 14 a distance substantially equal to or slightly greater than the thickness of mounting member 70 for a purpose to be described below. Generally, the canopy mounting member 70 is manufactured in the form of U-shaped troughs 71 having a thickness ranging from about 1/32 into to about 1/16 inch.

Figure 4:
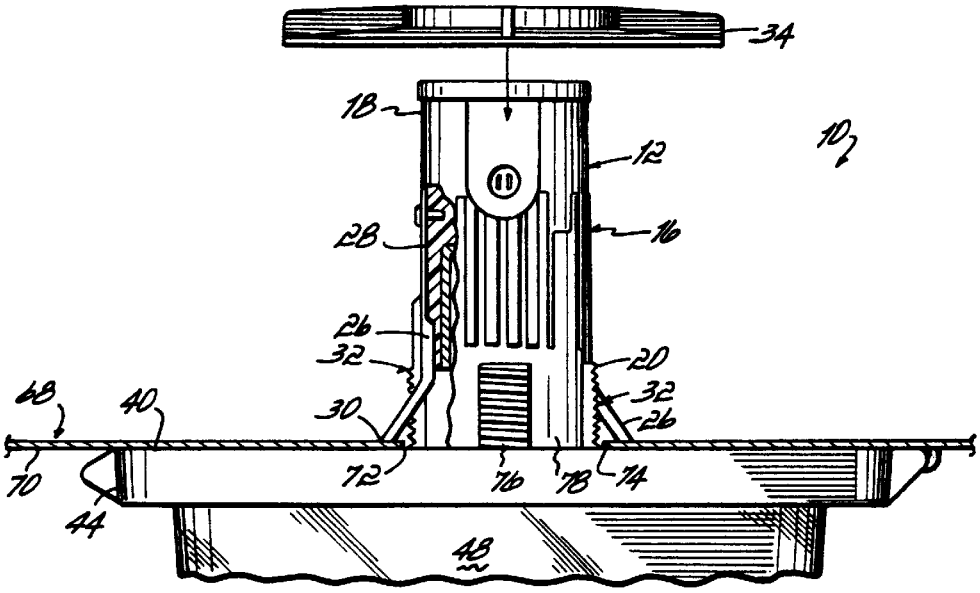
FIG. 4 is an illustrative view showing the canopy luminaire of FIG. 1 being inserted into a horizontal mounting member.
Figure 5:
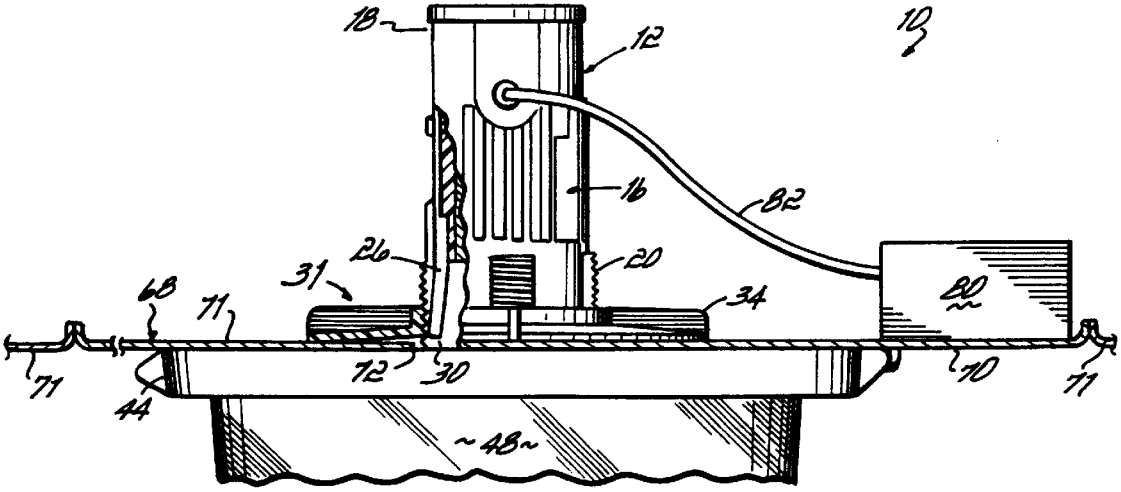
FIG. 5 is a view similar to FIG. 2, but with the canopy luminaire installed in a horizontal mounting member.

When luminaire housing 12 is to be mounted into horizontal mounting member 70 of a canopy 68, and as best seen in FIGS. 4 and 5, a generally circular aperture 72 is formed in horizontal mounting member 70 by a drill motor, hole saw, or any similar tool. Aperture 72 is sized to receive therethrough narrow neck 16 and threads 32. As luminaire housing 12 is extended upwardly through aperture 72, the periphery 74 of aperture 72 contacts lower end 30 of spring clips 26, deflecting spring clips 26 inwardly. As spring clips 26 emerge through aperture 72, they are biased outwardly toward their original undeflected shape such that lower end 30 of spring clips 26 extends outwardly over horizontal mounting member 70. At this point, spring clips 26 are able to, at least temporarily, support luminaire housing 12 from horizontal mounting member 70.

Luminaire housing 12 can then be permanently secured to horizontal mounting member 70 by threadably securing threaded nut 34 over threads 32. Preferably threads 32 are integrally formed on inner end 20 of narrow neck 16. However, as will be readily appreciated, threads 32 may be formed on a separate threaded sleeve that is secured to inner end 20.

To prevent interference between spring clips 26 and threads 32, threads 32 are preferably formed in four quadrants 76 spaced circumferentially about narrow neck 16. Spring clips 26 extend downwardly between the gaps 78 formed between quadrants 76 and are biased outwardly such that lower end 30 protrudes outwardly from the outer surface of threads 32. This permits threaded nut 34 to be secured to threads 32 without interference from spring clips 26. Rather, as threaded nut 34 is secured to threads 32, threaded nut 34 urges spring clips 26 inwardly into gaps 78 formed between quadrants 76.

Still further, it may be preferable for the control gear 80 to be external to luminaire housing 12. To this end, and as shown in FIG. 5, control gear 80 may be secured to canopy 68 adjacent canopy luminaire 10, but external therefrom and connected by any suitable electrical connectors 82, such as a standard watertight fitting as shown. As shown in FIGS. 1–5, outer end 18 of narrow neck 16 has been extended upwardly to accommodate electrical connectors 82. However, as will be readily appreciated, the wiring compartment for the electrical connectors may be formed separately from housing 12.

Figure 7:
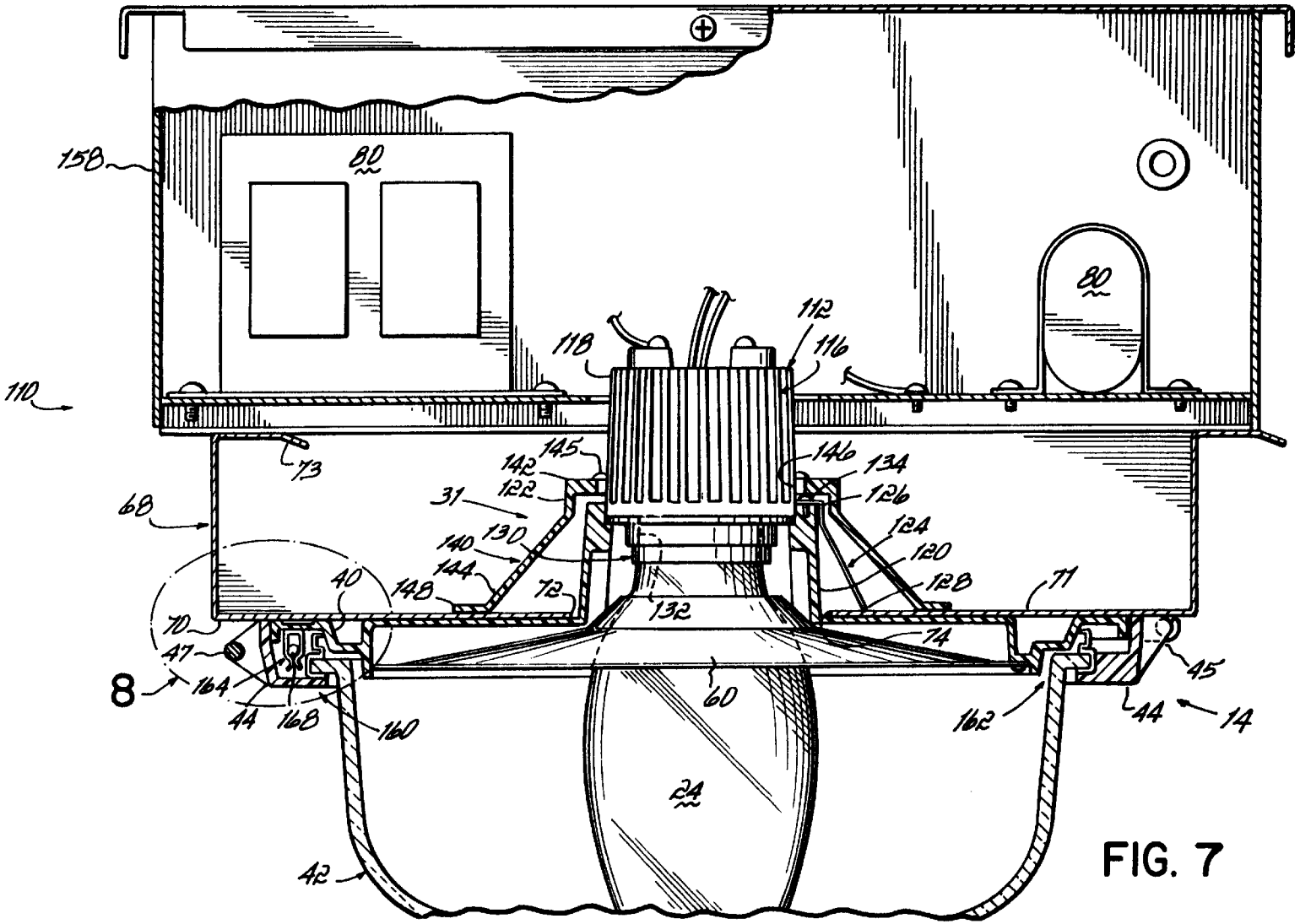
FIG. 7 is a section view along the line 7—7 of FIG. 6.

Typically, the control gear 80 would be mounted adjacent the edge of the mounting member trough 71, as shown. Such a location removes control gear 80 from the lamp heat and permits control gear 80 to be surrounded by cool, ambient air. This location also provides for convenient access to control gear 80 for maintenance. Still further, as shown in FIG. 7, control gear 80 may be located in compartment 158, which is in turn mounted on the tops 73 of adjoining U-shaped troughs 71 and fitted over, but not supported by or attached to, upper end 118 of luminaire housing 112. Further, the components of control gear 80 could be dispersed to the periphery of compartment 158, away from heat rising from luminaire 110. By positioning control gear 80 external to, rather than inside, luminaire housing 12, control gear 80 is subjected to lower hear variations and lower total temperature. As increased heat levels reduce the life of the control gear, external or remote mounting of control gear 80 from luminaire housing 12 increases the overall life of the components control gear 80.

Figure 6:
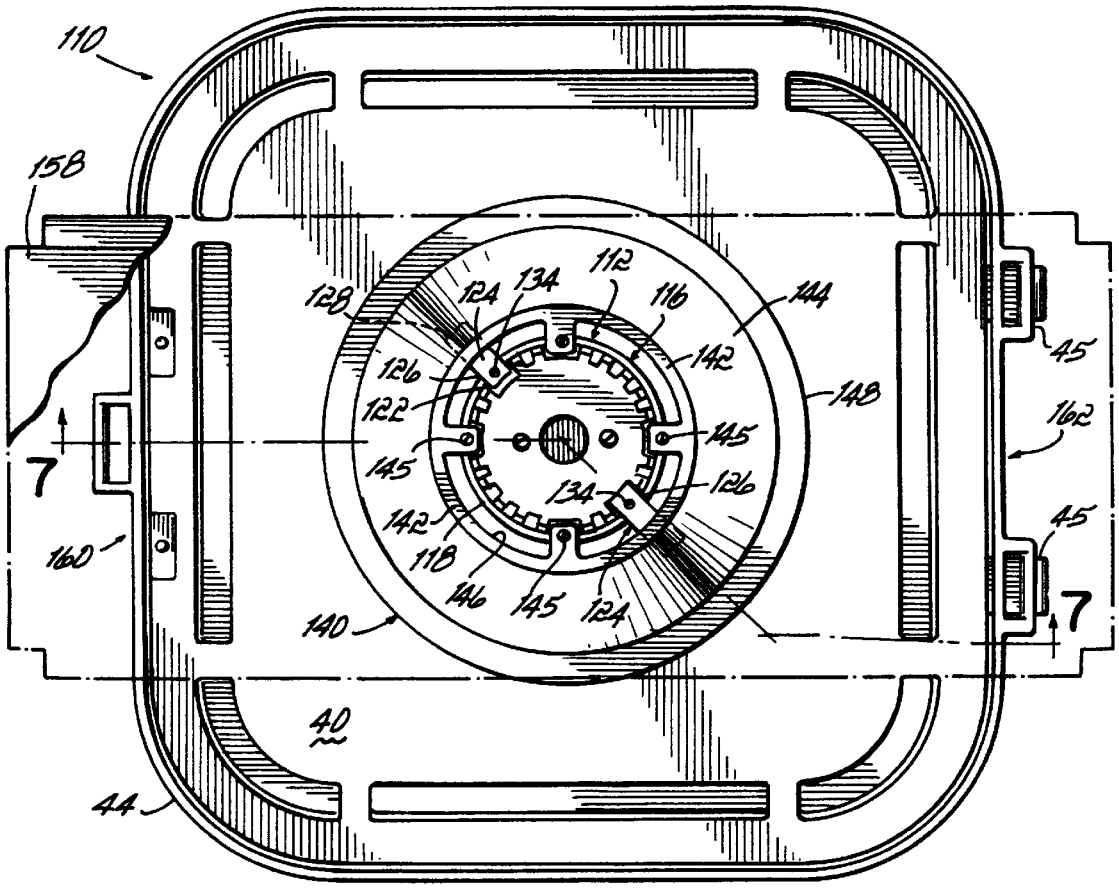
FIG. 6 is a top view of another canopy luminaire in accordance with the principles of the present invention.

With reference to FIGS. 6 and 7, there is shown another canopy luminaire 110 in accordance with the principles of the present invention similar to canopy luminaire 10 of FIGS. 1–5, with like parts having like numbers. Canopy luminaire 110 comprises a housing 112 having a bulbous body 14 configured to receive the light-emitting section of a lamp and a generally cylindrical, stepped narrow neck 116 with an outer end 118 and inner end 120 connected to bulbous body 14. The diameter of outer end 118 is less than that of inner end 120 such that there is a shelf 122 at the junction of outer end 118 and inner end 120. A pair spring clips 124 having an upper end 126 and a lower end 128 are secured at upper end 126 to opposing sides of shelf 122 by screws 134. Spring clips 124 extend downwardly and are biased outwardly from narrow neck 116 to lower end 128, which is spaced above base 40 of bulbous body 14 a distance substantially equal to or slightly greater than the thickness of mounting member 70. Spring clips 124 serve the same function as spring clips 26 in FIGS. 1–5. As will be readily appreciated, although two spring clips 124 are shown, any number of spring clips may be used without departing from the spirit or scope of the present invention.

A thermal stop 130 having an inner perimeter 132 sized to abut the outer surface of lamp 24 may be located within inner end 120 of narrow neck 116. As before, thermal stop 130 serves to reduce the amount of heat being transmitted by lamp 24 upwardly into narrow neck 116. Although thermal stop 130 is shown located within inner end 120 of narrow neck 116, it will be readily appreciated that thermal stop 130 may be located anywhere along the upper portion of lamp 24.

Luminaire housing 112 is mounted to horizontal mounting member 70 of a canopy 68 by the same technique as described with respect to the first embodiment. Specifically, a circular aperture 72 is formed in horizontal mounting member 70. Luminaire housing 112 is then extended upwardly through aperture 72, and the periphery 74 of aperture 72 contacts lower end 128 of spring clips 124, deflecting spring clips 124 inwardly. As spring clips 124 emerge through aperture 72, they are biased outwardly toward their original undeflected shape such that lower end 128 of spring clips 124 extend outwardly over horizontal mounting member 70 and support luminaire housing 112 therefrom.

To fixedly secure luminaire housing 112 to horizontal mounting member 70, locking component 31 comprises a clamp 140 having an upper end 142, a lower end 144, and an opening 146 therebetween sized to receive narrow neck 116 therein. Upper end 142 is adapted to be secured to shelf 122 of narrow neck 116, such as by screws 145 or other threaded fastening devices. Lower end 144 is adapted to engage horizontal mounting member 70, thereby securing luminaire housing 112 thereto. Preferably, clamp 140 has a frustro-conical configuration such that the diameter of upper end 142 is less than the diameter of lower end 144. Moreover, lower end 144 may include an outwardly extending annular flange 148 to provide greater surface area contact with mounting member 70. To secure luminaire housing 112 to mounting member 70, clamp 140 is attached to luminaire housing 112 by inserting screws through upper end 142, which presses lower end 144 downwardly onto mounting member 70, thereby clamping mounting member 70 tightly between clamp 140 and bulbous body 14. Although as shown clamp 140 is an integral component having a generally conical configuration, it will be readily appreciated that clamp 140 could be broken into several pieces, each of which has an upper end that is fixedly attached to shelf 122 and a lower end that engages mounting member 70.

In use, to mount canopy luminaire 10, 110, a single individual may form aperture 72 in horizontal mounting member 70 by way of a drill motor, hole saw, or similar tool. After forming aperture 72, outer end 18, 118 of narrow neck 16, 116 of luminaire housing 12, 112 is inserted into aperture 72 and extended upwardly. As luminaire housing 12 is extended upwardly through aperture 72, lower end 30, 128 of spring clips 26, 124 are deflected inwardly by periphery 74 of aperture 72. Luminaire housing 12, 112 is continued to be extended through aperture 72 until spring clips 26, 124 emerge beyond horizontal mounting member 70, enabling spring clips 26, 124 to be biased outwardly toward their original undeflected shape. At this point, luminaire housing 12, 112 may be supported from horizontal mounting member 70 by spring clips 26, 124.

The installer may then move to the top of canopy 68 where he may then place threaded nut 34 over luminaire housing 12 and threadably secure it over threads 32. (FIGS. 4 and 5). Alternatively, the installer then may place clamp 140 over luminaire housing 112 and secure upper end 142 of clamp 140 to shelf 122 of luminaire housing 112 by screws 145. (FIG. 7). By this method, luminaire housing 12, 112 is fixedly secured to canopy 68. Finally, the installer may then connect control gear 80 to luminaire housing 12 by any of the means described herein.

As will be readily appreciated by those skilled in the art, luminaire 10, 110 may be constructed without spring clips 26, 124 and still provide the other benefits of the present invention. In this embodiment, luminaire 10, 110 is secured to horizontal mounting member 70 by attaching locking component 31 to luminaire housing 12, 112.

Figure 11:
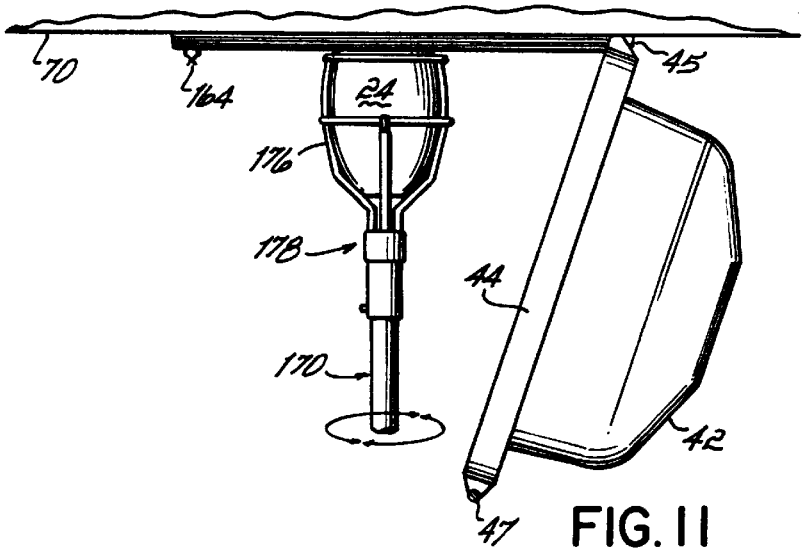
FIG. 11 is a schematic illustrative view showing removing/inserting a lamp for the canopy luminaire of FIG. 7.

In accordance with a further aspect of the present invention, luminaire 10, 110 is adapted to permit quick and easy replacement of lamp 24. To this end, and referring to FIGS. 7 and 8, prismatic glass lens 42, which is surrounded by frame 44, is hingedly secured to base 40 by a pair of hinges 45. This permits glass lens 42 to swing between a closed position, as shown in FIG. 7, and an open position, as shown in FIG. 11. Handle 47, for opening and closing glass lens 42, is secured to frame 44 at a first end 160 of base 40 of bulbous body 14. Hinges 45 are secured to the outside of frame 44 at a second, opposite end 162 of base 40 of bulbous body 14.

To releasably secure glass lens 42 in the closed position, a spring clasp 164 is secured at first end 160 of base 40. Spring clasp 164 comprises a pair of opposed, flexible fingers 166. A latch 168 is secured on the inside of frame 44, and is positioned to releasably engage spring clasp 164.

Figure 9:
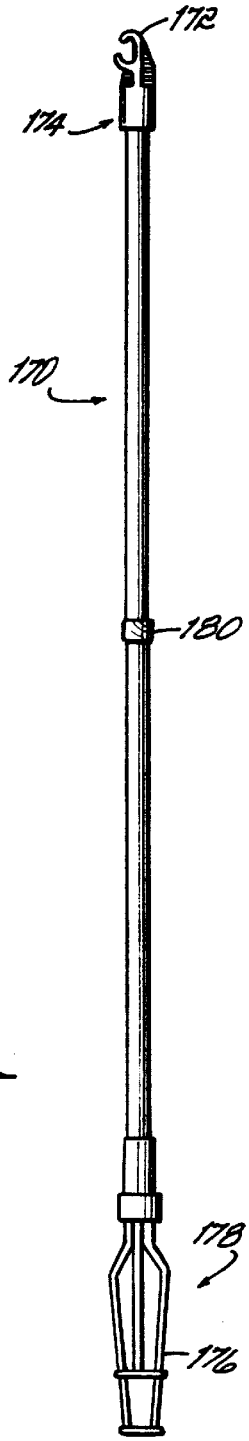
FIG. 9 is an elevation view of a lamp changing pole in accordance with a further aspect of the present invention.
Figure 12:
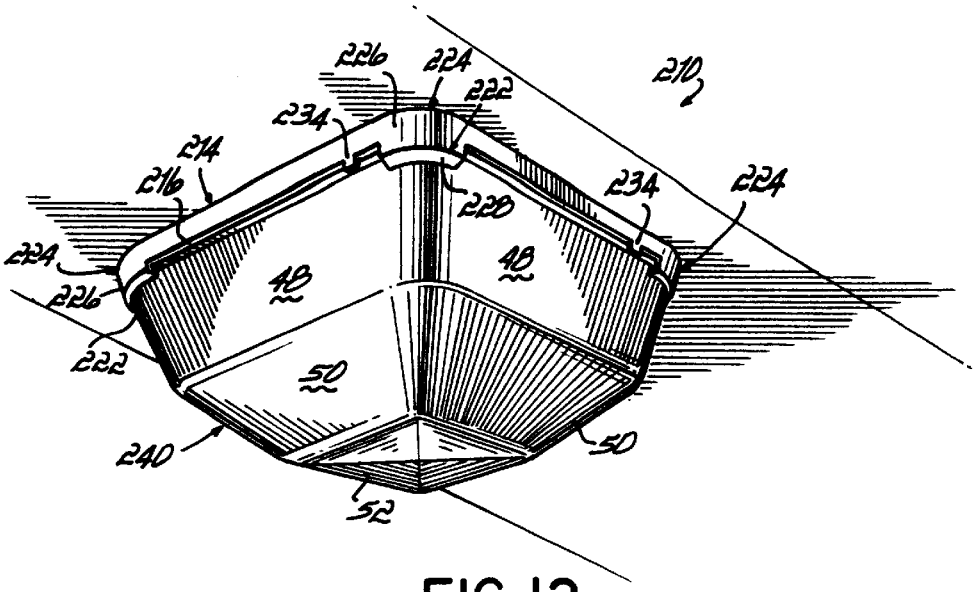
FIG. 12 is a bottom perspective view of another canopy luminaire in accordance with the principles of the present invention.
Figure 13:
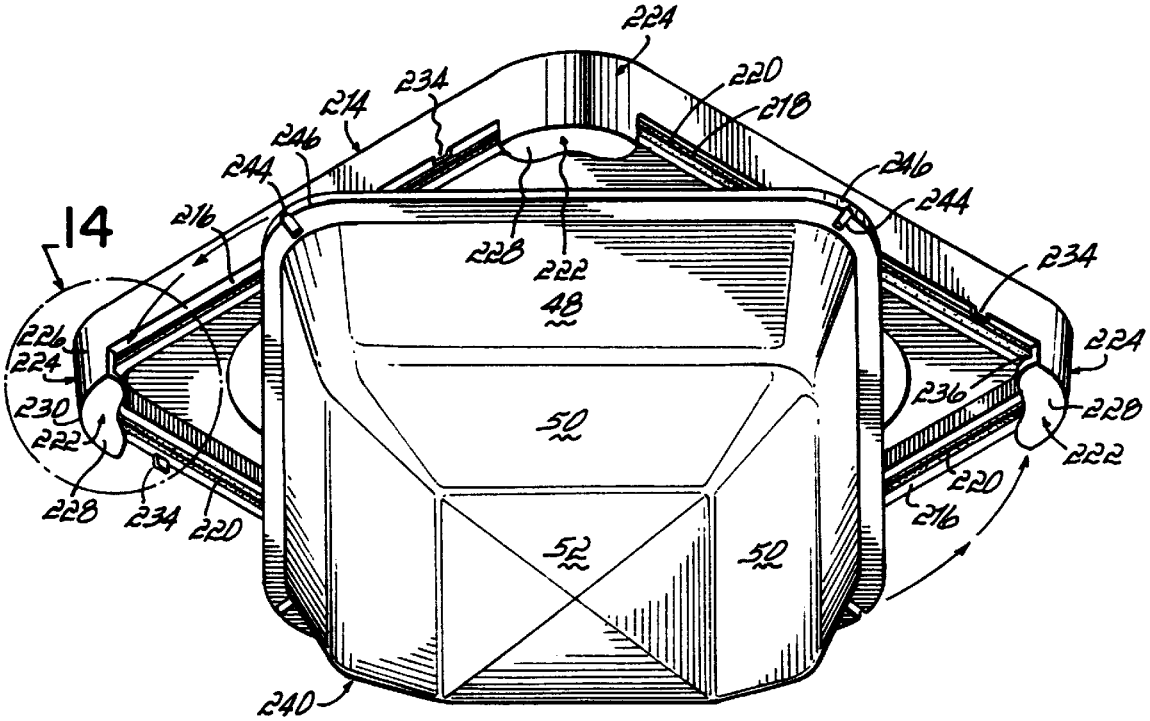
FIG. 13 is a bottom perspective view showing the glass lens of the canopy luminaire of FIG. 12 being rotatably secured to the base.
Figure 15:
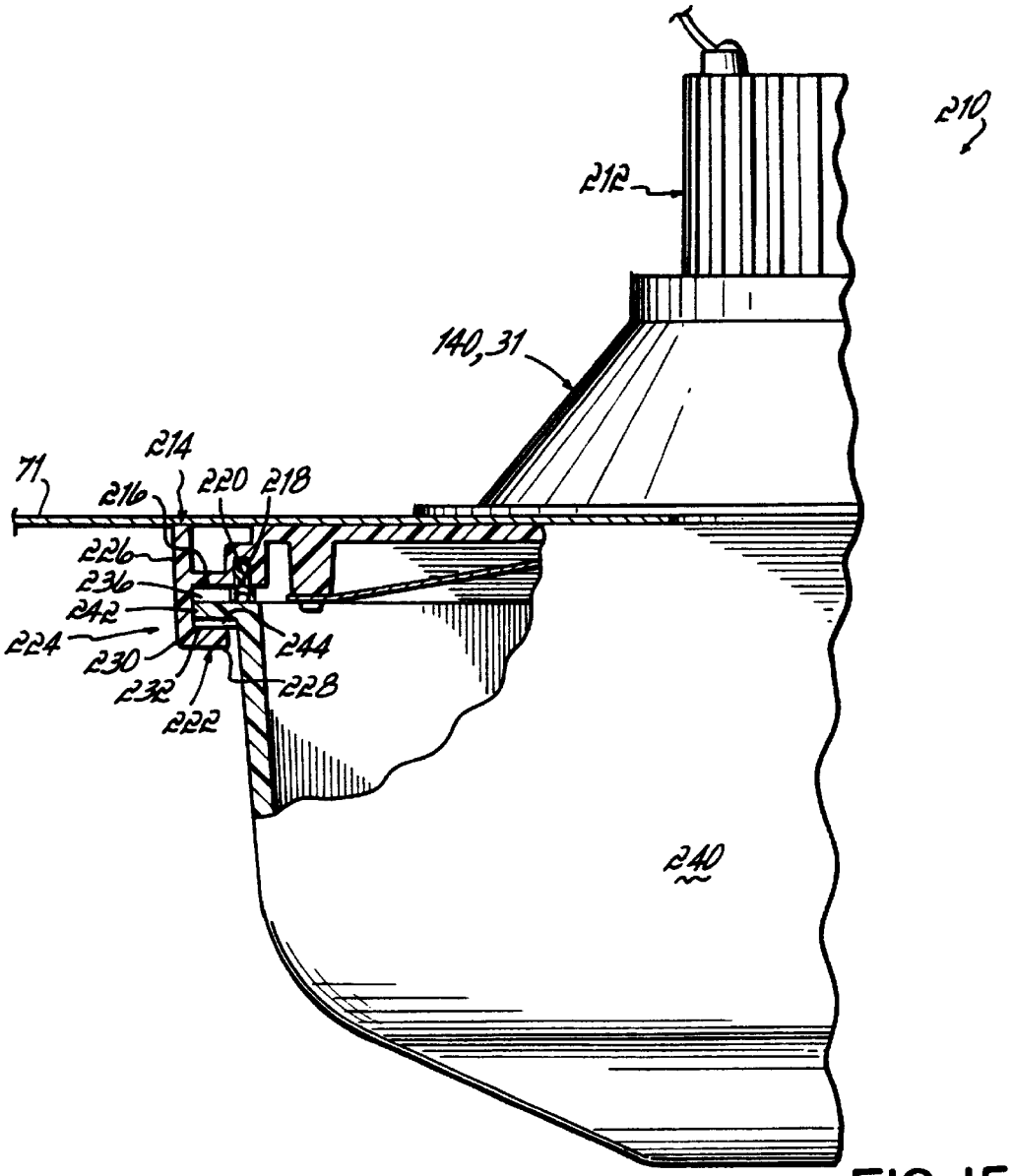
FIG. 15 is a side view partially in cross-section of a corner of the canopy luminaire of FIG. 12.
Figure 14:
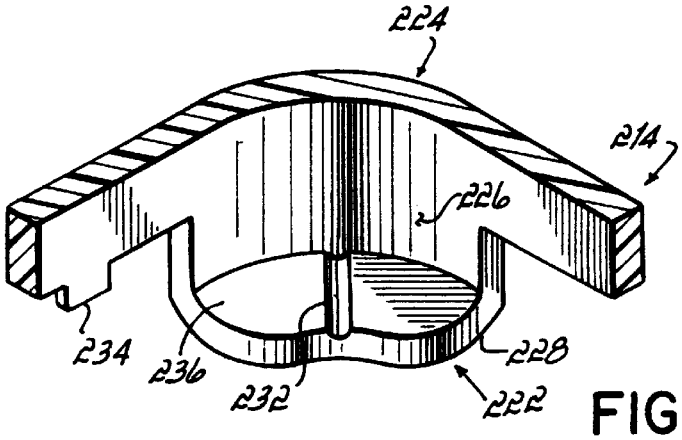
FIG. 14 is an enlarged top perspective view, broken away, of the circled portion of FIG. 13.
Figure 16:
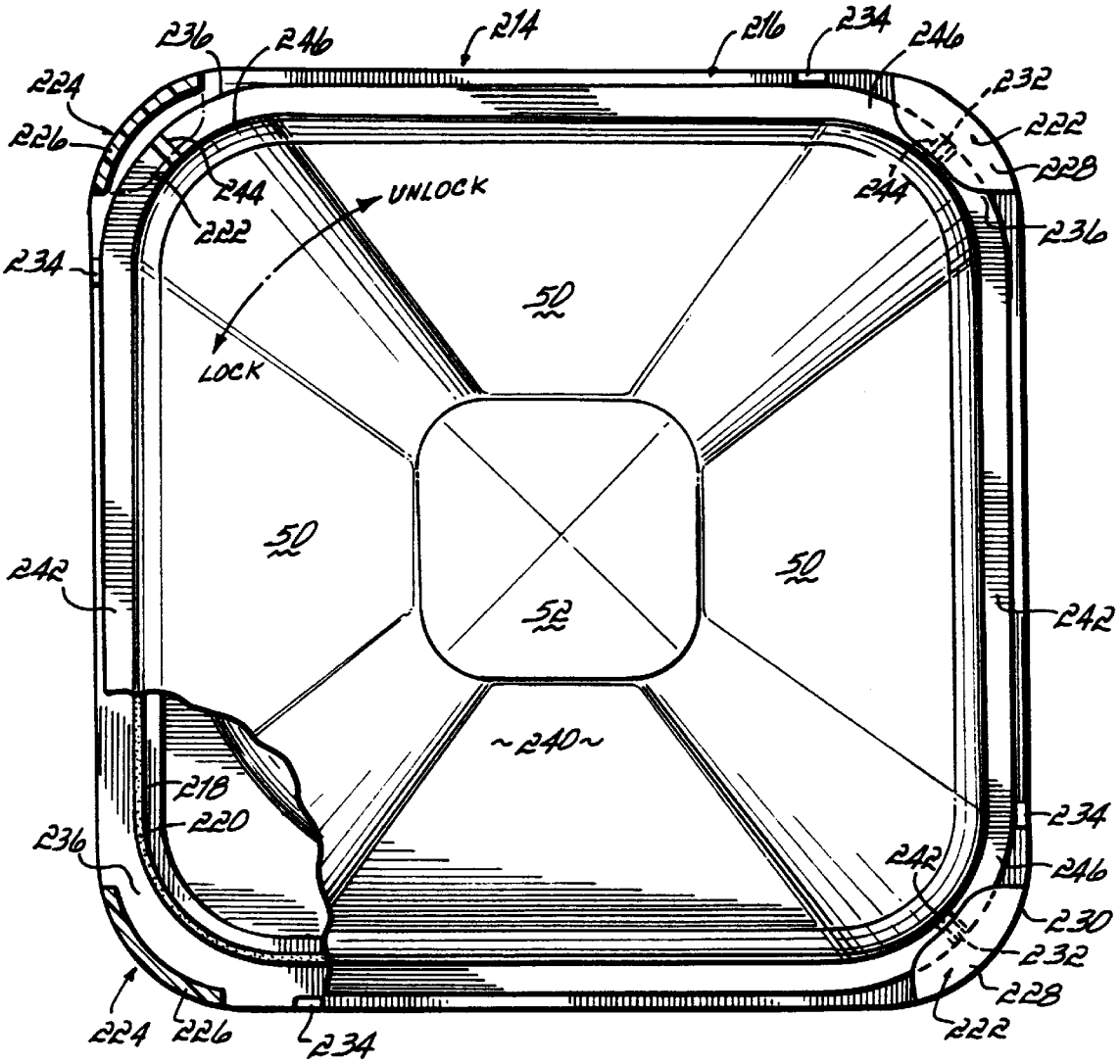
FIG. 16 is a bottom view, partially broken away, of the canopy luminaire of FIG. 12.

With reference to FIG. 9, to enable an individual to replace lamp 124 without the necessity of a ladder or other tools, lamp changing pole 170 is provided having a generally C-shaped hook 172 on a first end 174. A lamp gripper 176 is secured to the second end 178 of pole 170, the lamp gripper having a construction that is well known in the art. Moreover, pole 170 is of a length sufficient to enable the individual to reach luminaire 10, 110 from the ground, without the need for a ladder. Although C-shaped hook 172 and lamp gripper 176 are described as being attached to opposite ends of pole 170, it will be readily apparent that C-shaped hook 172 and lamp gripper 176 may be placed on separate poles without departing from the spirit or scope of the present invention.

Figure 10:
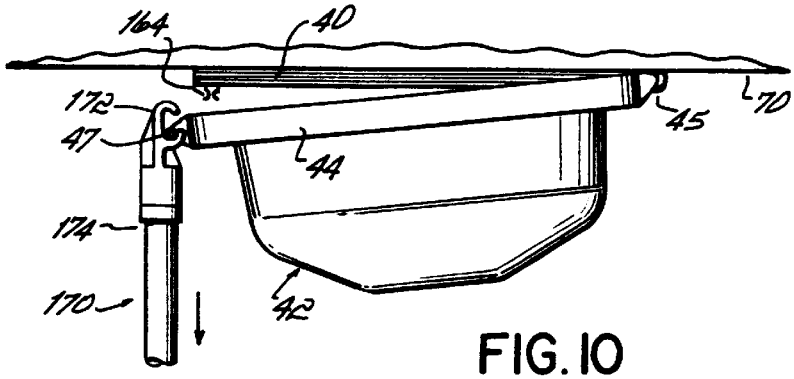
FIG. 10 is a schematic illustration view showing the opening/closing of the glass lens of FIG. 7.

C-shaped hook 172 is adapted to engage handle 47 for opening and closing of glass lens 42 as best seen in FIG. 10. Further, to electrically isolate the individual from any potential electric discharge from luminaire 10, 110, pole 170 includes a wooden segment 180, or other insulator, at the mid-point thereof.

In use, to replace a lamp, the individual engages handle 47 with hook 172. By moving pole 170 downwardly, latch 168 is disengaged from spring clasp 164. Hook 172 then supports handle 47 while glass lens 42 is being swung to the open position. (FIG. 10). Hook 172 is then disengaged from handle 47 and pole 170 is inverted. As illustrated in FIG. 11, the individual then engages lamp 24 with lamp gripper 176 and removes lamp 24. A second lamp is then inserted into lamp gripper 176, and this lamp is then inserted into luminaire 10, 110. Lamp gripper 176 is then disengaged from new lamp 24, pole 170 is inverted, and hook 172 is engaged with handle 47. Again, handle 47 is supported in hook 172 while glass lens 42 is swung to the closed position and latch 168 is releasably engaged with spring clasp 164.

Figure 8:
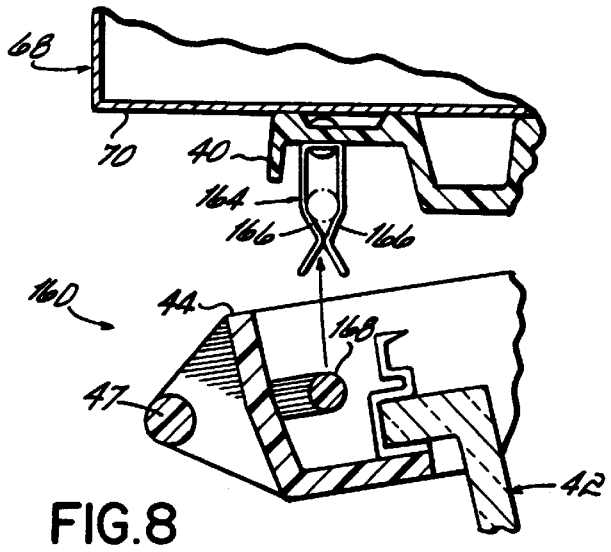
FIG. 8 is an enlarged view of the circled portion of the FIG. 7 with the latch released from the spring clasp.

Finally, with reference to FIGS. 12–16, there is shown a still further canopy luminaire 210 in accordance with the principles of the present invention similar to canopy luminaire 110 of FIGS. 6–8, with like parts having like numbers. Canopy luminaire 210 comprises a luminaire housing 212 having a polygonal, and preferably square, base 214 with a periphery 216. Although base 214 is preferably square, as will be readily appreciated by those skilled in the art, any shape base may be used. A peripheral groove 218 is formed in periphery 216 and a gasket 220 is secured within peripheral groove 218 for a purpose to be described below.

A shelf 222 is formed in each of the corners 224 of periphery 216. Shelf 222 comprises a wall 226 extending downwardly from periphery 216 and a floor 228 extending inwardly from the lower end 230 of wall 226. Formed within floor 228 are recesses 232. Also extending downwardly from periphery 216 are stops 234 that are positioned counterclockwise from and near each shelf 222. Together, periphery 216, wall 224, and floor 228 form channels 236.

Glass lens 240, which is generally square, includes an outwardly extending foot 242 having a detent 244 extending downwardly from each of the corners 246 of foot 242. Foot 242 is adapted to engage gasket 220, which is intermediate foot 242 and periphery 216 of base 214. Still further, foot 242 has a thickness that is sized to be slidably received within channels 236 to support glass lens 240 in shelves 222. Moreover, detent 244, which extends downwardly from foot 242, is adapted to operatively engage recess 232 in shelf 222 to releasably hold glass lens 240 to base 214.

In use, to secure glass lens 240 to base 214, glass lens 240 is pressed upwardly against gasket 220, such that foot 242 engages same. Gasket 220 is then deformed and glass lens 240 is rotated counterclockwise or a first direction until corners 246 and detents 244 are rotatably, slidably received in channels 236. Rotation of glass lens 240 is continued until foot 242 contacts stops 234, which prevents over rotation of glass lens 240. At this point, glass lens 240 is appropriately in line with base 214. Glass lens 240 is then released, gasket 220 urges glass lens 240 downwardly, and detent 244 operatively engages recesses 232 to releasably hold glass lens 240 to base 214. To remove glass lens 240, glass lens 240 is again pushed upwardly such that foot 242 compresses or deforms gasket 220. Glass lens 240 is then rotated clockwise or a second direction, releasing corners 246 from shelves 222. Glass lens 240 may then be lowered from base 214. As will be readily appreciated by those skilled in the art, canopy luminaire 210 may be adapted such that glass lens 240 is secured to base 214 by clockwise rotation and released from base 214 by counterclockwise rotation without departing from the spirit or scope of the present invention.

By virtue of the foregoing, there is thus provided a canopy luminaire that may be easily and quickly mounted into a horizontal mounting member by a single individual. Further, the canopy luminaire of the present invention includes a vertically oriented lamp to improve lighting of the target area. Still further, the canopy luminaire of the present invention includes control gear external to the luminaire housing, which extends the life of the components of the control gear, including the ballast. Finally, the canopy luminaire of the present invention permits an individual to quickly and easily replace a lamp.

While the present invention has been illustrated by description of a several embodiments which have been described in considerable detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and method, and illustrative examples shown and described. Accordingly, departures may be made form the details without departing from the spirit or scope of applicant's general inventive concept.

What is claimed is:

1. A light fixture adapted for installation adjacent to a generally horizontal panel having an opening therein, comprising:

a lamp housing including a lens configured to be located below said opening and having an interior configured to receive the light emitting section of a high intensity discharge lamp and operable to permit transmission of light from the light emitting section of the lamp, said lens dimensioned such that said lens cannot pass through said opening;

a temporary retainer attached to said lamp housing and having a retaining portion to secure said lamp housing adjacent to the panel with said lens disposed below said opening and said retaining portion disposed above said opening when said retaining portion of said temporary retainer is inserted upwardly through said opening;

electrical control gear for mounting above said panel, said electrical control gear including at least a ballast; and an electrical socket electrically connected to said electrical control gear and having an opening communicating with the lens interior for receiving a base of said lamp.

2. The light fixture of claim 1 further comprising:

a locking component operative from above the panel to fixedly secure said lamp housing adjacent said panel.

3. The light fixture of claim 1 wherein said temporary retainer includes a spring biased clip for securement of said lamp housing adjacent to the panel when said clip is inserted upwardly through the opening in the panel.

4. The light fixture of claim 1, wherein said electrical socket is positioned to orient the light emitting section of the lamp vertically when the base of the lamp and said electrical socket are installed above the horizontal panel.

5. The light fixture of claim 4, wherein said lens interior includes a vertical dimension after installation and said vertical dimension is approximately coextensive with the light emitting section of the lamp.

6. The light fixture of claim 1 further comprising a control gear housing containing said electrical control gear, said control gear housing adapted to be disposed above said opening after installation.

7. The light fixture of claim 6, wherein said control gear housing includes a lower opening, said electrical socket extending vertically into said lower opening.

8. The light fixture of claim 7, wherein said lower opening of said control gear housing, said electrical socket and the opening in the panel are vertically aligned after installation.

9. The light fixture of claim 1, wherein said electrical socket is located entirely above said lens after installation.

10. The light fixture of claim 1 further comprising said high intensity discharge lamp being received in said electrical socket.

11. The light fixture of claim 10 further comprising a control gear housing containing said electrical control gear, said control gear housing adapted to be spaced above said opening and said high intensity lamp after installation.

12. The light fixture of claim 1, wherein said lens is located below said generally horizontal panel and further comprising said high intensity discharge lamp engaged in said socket and extending vertically through said opening in said generally horizontal panel and into the interior of said lens with at least a portion of said socket located above said lens.

13. A canopy luminaire adapted for installation adjacent to a canopy panel having an opening therein, comprising:

a lamp housing including a lens configured to be located below said canopy panel and having an interior configured to receive the light emitting section of a high intensity discharge lamp and operable to permit transmission of light from the light emitting section of the lamp;

a connecting member extending from said lamp housing with an inner end interconnect to said lamp housing and with an outer end, said outer end configured to extend through the opening in said canopy panel when said housing is positioned adjacent said canopy panel; and a movable locking component separate from and securable to said connecting member from above said canopy panel when the outer end of said connecting member has been inserted upwardly through the opening in the canopy panel, said locking component movable between an unlocked position and a locked position relative to said connecting member to fixedly secure said lamp housing adjacent to said canopy panel.

14. The canopy luminaire of claim 13 further comprising:

a vertically oriented socket disposed within said connecting member and having an opening for receiving the base of the lamp.

15. The canopy luminaire of claim 13 further comprising:

electrical control gear locatable above the canopy panel, said electrical control gear including at least a ballast; and an electrical socket electrically connected to said control gear and adapted to receive the lamp.

16. The canopy luminaire of claim 13 further comprising an electrical socket positioned to orient the light emitting section of the lamp vertically when a base of the lamp and said electrical socket are installed above said opening.

17. The canopy luminaire of claim 16, wherein said lens interior includes a vertical dimension after installation and said vertical dimension is approximately coextensive with the light emitting section of the lamp.

18. The canopy luminaire of claim 16 further comprising a control gear housing containing electrical control gear which is electrically coupled with said socket, said housing adapted to be disposed above said opening after installation.

19. The canopy luminaire of claim 18, wherein said control gear housing includes a lower opening, said electrical socket extending vertically into said lower opening.

20. The canopy luminaire of claim 19, wherein said lower opening of said control gear housing, said electrical socket and the opening in the panel are vertically aligned after installation.

21. The canopy luminaire of claim 16, wherein said electrical socket is located entirely above said lens after installation.

22. The canopy luminaire of claim 13, wherein said lens is dimensioned such that said lens cannot pass through the opening in the canopy panel.

23. The canopy luminaire of claim 13 further comprising said high intensity discharge lamp having a light emitting section disposed within the lens interior.

24. The canopy luminaire of claim 23 further comprising electrical control gear electrically coupled with said high intensity lamp, and a control gear housing containing said electrical control gear, said control gear housing adapted to be spaced above said opening and said high intensity lamp after installation.

25. The light fixture of claim 12, wherein the vertical dimension of said light emitting section of said lamp is approximately coextensive with the vertical dimension of the interior of said lens and said socket is positioned entirely above said lens after installation.

26. The canopy luminaire of claim 13, wherein said lens is located below said canopy panel and further comprising an electrical socket, and high density discharge lamp being engaged in said socket and extending vertically through said opening in said canopy panel and into the interior of said lens with at least a portion of said socket located above said lens, and said lens being dimensioned such that said lens cannot pass through said opening in said canopy panel.

27. The canopy luminaire of claim 26, wherein the vertical dimension of said light emitting section of said lamp is approximately coextensive with the vertical dimension of the interior of said lens and said socket is positioned entirely above said lens after installation.

* * * * *

UNITED STATES PATENT AND TRADEMARK OFFICE

CERTIFICATE OF CORRECTION

PATENT NO. : 6,224,233 B1
DATED : May 1, 2001
INVENTOR(S) : Jerry F. Fischer et al.

It is certified that error appears in the above-identified patent and that said Letters Patent is hereby corrected as shown below:

Column 3,
Line 59, change “other” to -- corner --.

Column 5,
Line 57, change “preferably” to -- preferable --.

Column 6,
Line 20, change “into” to -- inch --.

Column 7,
Line 13, change “hear” to -- heat --.

Column 12,
Line 51, delete “and” and insert -- said -- therefor and change “density” to -- intensity --

Signed and Sealed this

Fifteenth Day of October, 2002

*Attest:*

*Attesting Officer*

JAMES E. ROGAN
*Director of the United States Patent and Trademark Office*